US005262376A

United States Patent [19]

Higashi

[11] Patent Number: 5,262,376

[45] Date of Patent: Nov. 16, 1993

[54] REVERSIBLE HEAT-SENSITIVE RECORDING MATERIAL

[75] Inventor: Hiroshi Higashi, Nagahama, Japan

[73] Assignee: Mitsubishi Plastics Industries Limited, Tokyo, Japan

[21] Appl. No.: 990,510

[22] Filed: Dec. 15, 1992

[51] Int. Cl.[5] ..... B41H 5/26

[52] U.S. Cl. ..... 503/217; 503/201; 503/225

[58] Field of Search ..... 503/201, 217, 225

[56] References Cited

U.S. PATENT DOCUMENTS 4,695,528 9/1987 Dabisch et al. ..... 430/290

FOREIGN PATENT DOCUMENTS 344789 12/1989 European Pat. Off. .

*Primary Examiner*—Pamela R. Schwartz

*Attorney, Agent, or Firm*—Oblon, Spivak, McClelland, Maier & Neustadt

[57] ABSTRACT

A reversible heat-sensitive recording material comprising a polymer resin matrix material and organic low molecular weight compounds dispersed in the matrix material, wherein as the low molecular weight compounds, (A) at least one of higher ketones having at least 15 carbon atoms and (B) at least one of aliphatic saturated dicarboxylic acids having at least 12 carbon atoms, are used in combination at a weight ratio of (A) to (B) within a range of from 98:2 to 30:70.

10 Claims, 1 Drawing Sheet

REVERSIBLE HEAT-SENSITIVE RECORDING MATERIAL

The present invention relates to a heat-sensitive recording material capable of repeatedly recording and erasing visible images thereon.

As a reversible heat-sensitive recording material, a material having a mixture of organic low molecular compounds dispersed in a polymer resin matrix material, has been proposed (Japanese Unexamined Patent Publication No. 154198/1980). This material has a characteristic such that when cooled to room temperature from a specific temperature range $T_1$, it turns transparent, and when cooled to room temperature from a temperature range $T_2$ higher than $T_1$, it turns turbid or opaque. By utilizing this characteristic, a visible image can reversibly be printed and erased.

However, this material has a problem that as the width of the temperature range $T_1$ for transparency is very narrow, the temperature control for printing and erasing a visible image is very difficult.

It is an object of the present invention to solve the above-mentioned problem.

The present invention provides a reversible heat-sensitive recording material comprising a polymer resin matrix material and organic low molecular weight compounds dispersed in the matrix material, wherein as the low molecular weight compounds, (A) at least one of higher ketones having at least 15 carbon atoms and (B) at least one of aliphatic saturated dicarboxylic acids having at least 12 carbon atoms, are used in combination at a weight ratio of (A) to (B) within a range of from 98:2 to 30:70.

Now, the present invention will be described in detail with reference to the accompanying drawings.

Figure 1:
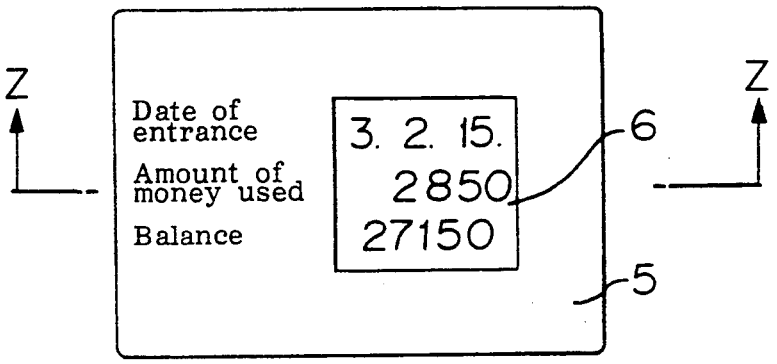
FIG. 1 is a plan view of a card as an embodiment of the recording material of the present invention.

In the present invention, the polymer resin matrix material may be any resin so long as it is transparent and has a good film-forming property. It may, for example, be polyvinyl chloride, a vinyl chloride copolymer such as a vinyl chloride-vinyl acetate copolymer, polyvinylidene chloride, a vinylidene chloride copolymer, a polyester, a polyamide, a polystyrene, a polymethyl (meth-)acrylate or its copolymer.

As the organic lower molecular weight compounds to be dispersed in such a polymer resin matrix material, (A) at least one of higher ketones having at least 15 carbon atoms and (B) at least one of aliphatic saturated dicarboxylic acids having at least 12 carbon atoms are used in a weight ratio of (A) to (B) within a range of from 98:2 to 30:70. By changing the blending ratio of these organic low molecular weight compounds, the temperature range $T_1$ for transparency can freely be changed. Accordingly, the blending ratio may be set taking into consideration the performance of the printing and erasing apparatus and the film-forming property of the recording material.

Component (A) usually has a melting point of from 40° to 90° C., whereas the melting point of component (B) is usually at a level of from 110° to 130° C. Accordingly, by mixing these components, the change to transparency takes place at a temperature around the melting point of the mixture due to their co-melting effects.

The higher ketones having at least 15 carbon atoms to be used as component (A) include, for example, 8-pentadecanone, 9-heptadecanone, 10-nonadecanone, 11-heneicosanone, 12-tricosanone, 14-heptacosanone, 16-hentriacontanone, 18-pentatriacontanone, 22-tritetracontanone, 2-pentadecanone, 2-hexadecanone, 2-heptadecanone, 2-octadecanone and 2-nonadecanone. The aliphatic saturated dicarboxylic acids having at least 12 carbon atoms to be used as component (B) include, for example, dodecanedioic acid, tridecanedioic acid, tetradecanedioic acid, pentadecanedioic acid, hexadecanedioic acid, octadecanedioic acid, nonadecanedioic acid, eicosanedioic acid, heneicosanedioic acid, docosanedioic acid, tricosanedioic acid, tetracosanedioic acid, hexacosanedioic acid, triacontanedioic acid and tetratriacontanedioic acid.

The weight ratio of component (A) to component (B) is required to be within the above-mentioned range. If the proportion of component (B) is less than 2% by weight, there will be no effect to enlarge the width of the temperature range $T_1$. On the other hand, if the proportion of component (B) exceeds 70% by weight, film-forming of the recording material layer tends to be difficult. A preferred weight ratio of component (A) to component (B) is within a range of 90:10 to 50:50 in view of the balance of the temperature range $T_1$ and the film-forming property.

The total amount of components (A) and (B) is within a range of from 10 to 80 parts by weight, preferably from 30 to 60 parts by weight, per 100 parts by weight of the resin matrix material. In addition to the two components, other organic low molecular weight compounds as disclosed in e.g. Japanese Unexamined Patent Publication No. 154198/1980, may further be incorporated.

Preferred third component (C) is a higher fatty acid having at least 16 carbon atoms. By incorporating this component (C), it is possible to increase the opacity (or the turbidity) when opacified (or turbidified), and thus to obtain a recording material having a wide temperature range for transparency and a high contrast of the image.

The higher fatty acid having at least 16 carbon atoms as component (C) may, for example, be palmitic acid, stearic acid, docosanoic acid, lignoceric acid, cerotic acid, montanic acid, melissic acid, heptadecanoic acid, nonadecanoic acid, eicosanoic acid, heneicosanoic acid, heptacosanoic acid, 2-hexadecenoic acid, 2-heptadecenoic acid, elaidic acid or erucic acid. These acids may be used alone or in combination as a mixture of two or more of them.

Component (C) is incorporated preferably in an amount of at least 3% by weight of the total amount of components (A), (B) and (C). Particularly preferably, the weight ratio of component (A):components (B) and (C) is within a range of from 90:10 to 50:50, and the weight ratio of component (B):component (C) is within a range of from 90:10 to 70:30. The total amount of components (A), (B) and (C) is from 10 to 80 parts by weight, preferably from 30 to 70 parts by weight, per 100 parts by weight of the resin matrix material.

This recording material becomes transparent when heated to the temperature range $T_1$ by a heating means such as a thermal head, a heating stamp or a heating roll. Then, when this transparent recording material is locally heated to a temperature $T_2$ higher than $T_1$ by a thermal head or a heat printing plate, only the heated portion will be opacified (turbidified) to form a visible image.

To erase the image, the recording material may be heated again to the temperature range $T_1$.

If the width of the temperature range $T_1$ for transparency is less than 5° C., temperature control of a heating means such as a thermal head will be difficult, whereby it tends to be difficult to obtain a stabilized transparent state. On the other hand, if the width of the temperature range exceeds 60° C., the temperature $T_2$ for printing is obliged to be too high, and heat deterioration of the recording material due to repetition of printing and erasing, tends to proceed quickly. According to the present invention, it is possible to easily obtain a width of the temperature range of e.g. from 30° to 50° C. for such transparency.

Figure 2:
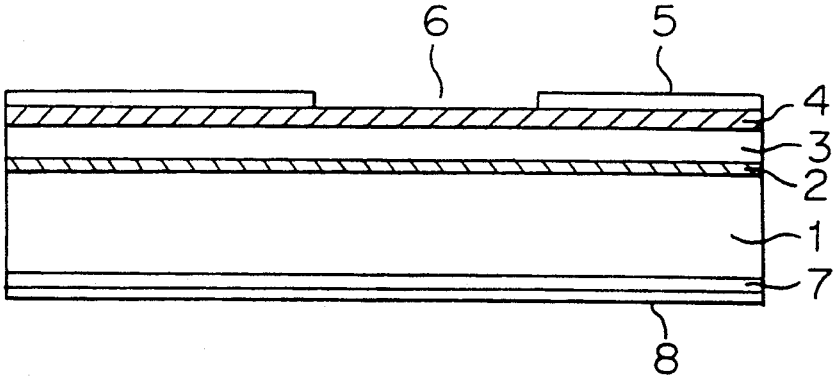
FIG. 2 is a cross-sectional view of the same card taken along line Z—Z in FIG. 1.

FIGS. 1 and 2 show a card as an embodiment of the recording material of the present invention. A reflecting layer 2, a recording material layer 3, a protective layer 4 and a print layer 5 to form a visible record display window, are laminated on the front surface of a synthetic resin substrate sheet 1 made of e.g. polyethylene terephthalate (PET). On the rear side, a magnetic recording layer 7 and a protective layer 8 are provided.

The reflecting layer 2 serves to improve the visibility of an image formed in the recording material layer 3, and it is preferably a vapor deposition layer or foil of e.g. aluminum or tin or a coated layer having a metal powder incorporated.

The protective layer 4 serves to prevent heat deterioration of the recording material layer 3 and may be a heat resistant transparent resin film or coated layer of e.g. PET, polyetherimide, polyether ether ketone, polysulfone, polyphenylene sulfide, polyallylate, polyethersulfone, polycarbonate, polyethylene naphthalate, polyimide or acrylic resin.

This card may be used, for example, as a pre-paid card for admission, shopping or rental. Each time when it is used, the amount of money used and the balance will be visibly displayed in the recording material layer 3 together with the magnetic recording, so that the user will always be able to know the accurate balance.

Now, the present invention will be described with reference to Examples. However, it should be understood that the present invention is by no means restricted to such specific Examples.

EXAMPLE 1

On the front surface of a PET sheet having a thickness of 188 μm and having a magnetic recording layer preliminarily formed on the rear side in a thickness of 10 μm, aluminum was vapor-deposited as a reflecting layer. On the reflecting layer, a solution in tetrahydrofuran of a recording material prepared by adding 12-tricosanone (melting point: 69° C.) as an organic low molecular weight compound of component (A) and 1,12-tetradecanedioic acid (melting point: 126° C.) as component (B) in the amounts as identified in Table 1 to 100 parts by weight of a vinyl chloride-vinyl acetate copolymer (MRP-TS, manufactured by Nisshin Kagaku K.K.), was coated and dried to form a recording material layer having a thickness of 10 μm.

On the recording material layer, a PET film having a thickness of 2 μm was bonded as a protective layer, and printing was conducted to form a visible recording display window. On the other hand, a protective layer was formed on the magnetic recording layer on the rear side, followed by punching in the form of a card.

Each card thus obtained was heated from 50° C. to 120° C. with intervals of 1° C., whereby the reflection density of the recording material at each temperature was measured by McBeth reflection density meter RD-914.

The temperature range $T_1$ for transparency and its temperature width were determined on the basis such that the case where the measured value was not more than 0.5 was evaluated as opaque and the case where the measured value is not less than 1.0 was evaluated as transparent. The results are shown in Table 1. In Table 1, experiment Nos. 1 to 5 represent the present invention, and experiment Nos. 6 and 7 represent Comparative Examples.

TABLE 1

| No. | Component (A) (parts by weight) | Component (B) (parts by weight) | Temp. range $T_1$ for transparency (°C.) | Temp. width (°C.) |
|---|---|---|---|---|
| 1 | 35 | 15 | 66–106 | 41 |
| 2 | 25 | 25 | 66–112 | 47 |
| 3 | 15 | 35 | 66–108 | 43 |
| 4 | 45 | 5 | 68–97 | 30 |
| 5 | 49 | 1 | 68–72 | 5 |
| 6 | 10 | 40 | Failed to form a film | — |
| 7 | 50 | 0 | 68 | 1 |

It is evident that in experiment Nos. 1 to 5 wherein recording materials of the present invention were used, the temperature width of the temperature range $T_1$ for transparency is wide, and even when the heating temperature varies to some extent, a stable transparent state can be obtained.

Whereas, in experiment No. 6 where the proportion of component (B) was too high, film-formation of the recording material layer was difficult, and it was impossible to obtain a smooth surface, and in experiment No. 7 wherein no component (B) was incorporated, the temperature for transparency was a single point of 68° C., whereby it was extremely difficult to attain a transparent state.

The recording material layer of the card in each of experiment Nos. 1 to 5 was heated to 85° C. and then cooled to room temperature so that the layer became transparent. Then, a letter was printed by a thermal head with a printing energy of 1.3 joule/cm$^2$. Then, such a card was heated to a temperature within the temperature range for transparency, whereby the letter was erased. Such an operation was repeated 1000 times, whereby the same visibility was obtained.

EXAMPLE 2

Experiments were conducted in the same manner as in Example 1 except that docosanoic acid was added in the amount (parts by weight) as identified in Table 2 as component (C) in addition to 12-tricosanone as an organic low molecular weight compound of component (A) and 1,12-tetradecanedioic acid as component (B). In addition to the temperature range $T_1$ for transparency and its temperature width, the maximum reflection density at the time of transparency and the minimum reflection density at the time of non-transparency were obtained. The results are shown in Table 2.

TABLE 2

| | No. | | | |
|---|---|---|---|---|
| | 8 | 9 | 10 | 11 |
| Component (A) | 40 | 35 | 30 | 35 |

TABLE 2-continued

| | No. | | | |
|---|---|---|---|---|
| | 8 | 9 | 10 | 11 |
| Component (B) | 10 | 15 | 20 | 15 |
| Component (C) | 2 | 2 | 3 | 0 |
| Temp. range $T_1$ for transparency (°C.) | 66–102 | 66–106 | 66–109 | 66–106 |
| Temp. width (°C.) | 37 | 41 | 44 | 41 |
| Reflection density | | | | |
| Maximum | 1.3 | 1.3 | 1.3 | 1.3 |
| Minimum | 0.25 | 0.25 | 0.25 | 0.50 |

From the above results, it is evident that in experiment Nos. 8 to 10 wherein component (C) was incorporated, the difference in the reflection density was larger than in experiment No. 11 wherein no component (C) was incorporated, thus indicating that incorporation of component (C) is preferred.

The recording material of the present invention has a wide width of the temperature range for transparency, whereby a stable transparent state can be obtained even when the heating temperature varies. Accordingly, it is suitable to display a visible image which can repeatedly be printed and erased, for example, on a pre-paid card.

I claim:

1. A reversible heat-sensitive recording material comprising a polymer resin matrix material and organic low molecular weight compounds dispersed in the matrix material, wherein as the low molecular weight compounds, (A) at least one of higher ketones having at least 15 carbon atoms and (B) at least one of aliphatic saturated dicarboxylic acids having at least 12 carbon atoms, are used in combination at a weight ratio of (A) to (B) within a range of from 98:2 to 30:70.

2. The recording material according to claim 1, wherein the weight ratio of component (A) to component (B) is within a range of from 90:10 to 50:50.

3. The recording material according to claim 1, wherein the total amount of components (A) and (B) is within a range of from 30 to 60 parts by weight, per 100 parts by weight of the resin matrix material.

4. The recording material according to claim 1, wherein as an additional low molecular weight compound, (C) at least one higher fatty acid having at least 16 carbon atoms is used at a weight ratio of at least 3% by weight of the total amount of components (A), (B) and (C).

5. The recording material according to claim 4, wherein the weight ratio of component (A) to components (B) and (C) is from 90:10 to 50:50, and the weight ratio of component (B) to component (C) is from 90:10 to 70:30.

6. The recording material according to claim 4, wherein the total amount of components (A), (B) and (C) is from 30 to 70 parts by weight, per 100 parts by weight of the resin matrix material.

7. The recording material according to claim 1, wherein component (A) is at least one member selected from the group consisting of 8-pentadecanone, 9-heptadecanone, 10-nonadecanone, 11-heneicosanone, 12-tricosanone, 14-heptacosanone, 16-hentriacontanone, 18-pentatriacontanone, 22-tritetracontanone, 2-pentadecanone, 2-hexadecanone, 2-heptadecanone, 2-octadecanone and 2-nonadecanone.

8. The recording material according to claim 1, wherein component (B) is at least one member selected from the group consisting of dodecanedioic acid, tridecanedioic acid, tetradecanedioic acid, pentadecanedioic acid, hexadecanedioic acid, octadecanedioic acid, nonadecanedioic acid, eicosanedioic acid, heneicosanedioic acid, docosanedioic acid, tricosanedioic acid, tetracosanedioic acid, hexacosanedioic acid, triacontanedioic acid and tetratriacontanedioic acid.

9. The recording material according to claim 4, wherein component (C) is at least one member selected from the group consisting of palmitic acid, stearic acid, docosanoic acid, lignoceric acid, cerotic acid, montanic acid, melissic acid, heptadecanoic acid, nonadecanoic acid, eicosanoic acid, heneicosanoic acid, heptacosanoic acid, 2-hexadecenoic acid, 2-heptadecenoic acid, elaidic acid and erucic acid.

10. The recording material according to claim 1, wherein the resin matrix material is polyvinyl chloride, a vinyl chloride copolymer, polyvinylidene chloride, a vinylidene chloride copolymer, a polyester, a polyamide, a polystyrene, a polymethyl (meth)acrylate or a copolymer thereof.

* * * * *